US005988553A

United States Patent [19]

Jönsson

[11] Patent Number: 5,988,553

[45] Date of Patent: Nov. 23, 1999

[54] ENTANGLING PROTECTION ARRANGEMENT FOR A THREAD FEEDING BUFFER

[75] Inventor: Peder Jönsson, Mölndal, Sweden

[73] Assignee: Aplicator System AB, Sweden

[21] Appl. No.: 09/033,817

[22] Filed: Mar. 3, 1998

[51] Int. Cl.[6] ..... B65H 23/18; B65H 59/10; B65H 20/24

[52] U.S. Cl. ..... 242/417; 226/44; 226/118.3; 242/419.3

[58] Field of Search ..... 242/419.1, 419.3, 242/419.4, 417; 226/118.3, 44

[56] References Cited

U.S. PATENT DOCUMENTS

| | | | |
|---|---|---|---|
| 1,836,613 | 12/1931 | Oehmichen . | |
| 2,589,366 | 3/1952 | Gauthier . | |
| 3,501,075 | 3/1970 | Scharf | 226/44 X |
| 3,826,438 | 7/1974 | Stanley . | |
| 4,962,796 | 10/1990 | Grimm et al. . | |
| 5,031,847 | 7/1991 | Tanaka | 226/118.3 X |
| 5,139,206 | 8/1992 | Butler . | |
| 5,602,747 | 2/1997 | Rajala | 226/44 X |
| 5,810,236 | 9/1998 | Yoshida et al. | 226/118.3 |

FOREIGN PATENT DOCUMENTS

| | | |
|---|---|---|
| 564018 | 10/1993 | European Pat. Off. . |
| 3241362 | 5/1984 | Germany . |
| 5278943 | 10/1993 | Japan . |
| 1034082 | 8/1983 | U.S.S.R. . |
| 1219691 | 3/1986 | U.S.S.R. . |
| 930347 | 7/1963 | United Kingdom . |
| 2117015 | 10/1983 | United Kingdom . |

*Primary Examiner*—Michael R. Mansen
*Attorney, Agent, or Firm*—Ostrolenk, Faber, Gerb & Soffen, LLP

[57] ABSTRACT

A thread feeding buffer for feeding a fibre thread from a magazine roll to a feed apparatus at a robot arm which is freely movable in the room. The thread feeding buffer including a thread brake and at least one movable thread guide on which a thrust force is acting. The thread is running from the magazine roll via a brake through the thread guide and further on towards the feed apparatus in such a way, that the thrust force acts for creation of a thread buffer between the brake and the feed apparatus, which buffer is variable in length. At least one guide rod for guiding the movable thread guide is arranged to cause a braking effect on downward movement of the movable thread guide for preventing entanglement of the thread fed through the movable thread guide following a rapid fall of the movable thread guide.

14 Claims, 1 Drawing Sheet

ENTANGLING PROTECTION ARRANGEMENT FOR A THREAD FEEDING BUFFER

FIELD OF THE INVENTION

The present invention is related to a thread feeding buffer for feeding a fibre thread from a magazine roll to a feed apparatus at a robot arm which is freely movable in the room, and of the type, which is described in U.S. patent application Ser. No. 08/693,155 now U.S. Pat. No. 5,906, 330.

BACKGROUND OF THE INVENTION

The production of fibre reinforced thermosetting plastic products can be automatized by the use of an industrial robot, by means of which a fibre feed apparatus can be controlled, so that precise amounts of fibers are fed out which are oriented for maximum strength, without the fibers projecting out through the outer plastic layer of the product. Owing to the repeatability of the robot, the quality of these products can be increased considerably, simultaneously as problems related to bad work environment and labor fatigue can be solved.

The fibre feeding apparatus is preferably located in a feedout head which can be mounted upon a movable robot arm. One or more fibre threads are supplied to the feedout head, which cuts the threads in suitable lengths. The feeding speed of the fibre thread can be in the range of about 10 meters per second. At such a feeding speed, it is difficult to stop the feeding of thread without any risk of getting the thread tangled.

The features defined in the above mentioned older application solve in an efficient manner the problems defined above.

However it has proven itself that there can still occur some risk for entanglement when the yoke provided with the movable thread guide moves downwards at a high speed. When the yoke then reaches its lower position there might be a bounce making the fed fibre thread slacken and become tangled.

The Technical Problem

The object of the invention is therefore to provide an arrangement at a thread feeding buffer which solves the above described problem.

The Solution

For this purpose the entangling protection arrangement for a thread feeding buffer for a fibre thread fed from a supply and along a path comprising a first guide for the thread, for receiving the thread from the supply, a contactable brake surface over which the thread is fed from the first guide; a brake element movement into control with the brake surface for bracking movement of the thread past the brake surface; a moveable thread guide in the path of the thread past the brake surface, a support comprising two substantially vertically arranged guide rods supporting the movable thread guide for movement; a further guide following the movable thread guide in the path of the thread and past which the thread is draw; the support enabling the movable thread guide to be moved by the thread to reduce the length of the thread path between the brake element engaging the brake surface and also permitting the movable thread guide to move to lengthen the distance between the brake surface and the further thread guide to absorb slack in the thread on the path between the brake surface and the further thread guide, is characterized in that at least one of said guide rods is provided with means arranged to cause a braking effect on downward movement of the movable thread guide for preventing entanglement of the thread fed through the movable thread guide following a rapid fall of said movable thread guide.

BRIEF DESCRIPTION OF THE DRAWINGS

The invention will hereinafter be described with reference to an embodiment schematically shown in the accompanying, drawing, in which.

DESCRIPTION OF PREFERRED EMBODIMENTS

Figure 2:
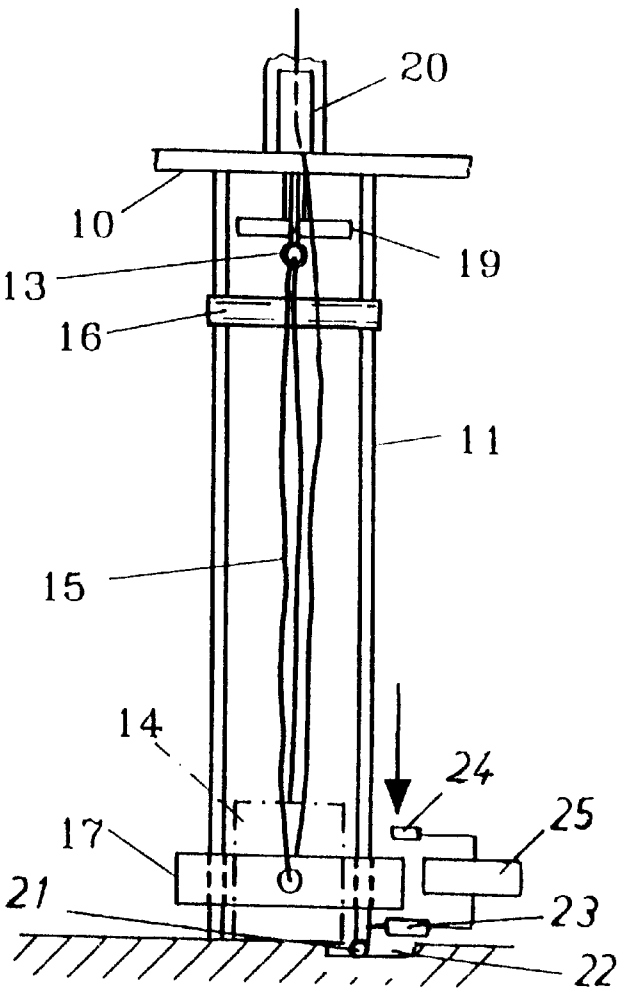

The thread feeding buffer according to the drawing comprises a stand 10 with two vertical guide rods 11. The stand 10 carries an elbow arm 12 with a thread eyelet 13 for a thread 15 which is wound off from a roll 14. The thread can consist of a multiple fibre thread of glass, carbon fibre or synthetic fibre. The thread eyelet 13 provides for a substantially friction free passage of the thread.

The thread runs upwards from the roll 14 which is located at ground level, through the thread eyelet 13 and further over a bar 16 which changes the direction of pull back vertically down between the guide rods 11. A thread guide 17 is movably guided by the guide rods and is provided with further thread eyelets 13, through which the thread 15 runs. Then the thread runs on from the thread guide 17 in the direction upwards to a thread guide channel 18, which guides the thread further to a not shown robot arm.

A thread brake cooperates with the bar 16 and is composed of a clamp plate 19, which is mounted at the outer end of a pneumatic cylinder 20 which is connected to the stand 10. The clamp plate can be brought in or out of engagement with the bar 16 by operation of the cylinder 20, whereby the feeding of the thread will be stopped.

The thread feeding buffer operates in the following way: During normal thread feeding, the pulling of the thread, via the thread eyelets 13 and the bar 16, creates an even resistance in the thread which results in an advantageous even outfeed. If the robot arm is moving in the room, so that more or less thread has to be fed out momentarily, the thread guide 17 will be able to move up and down respectively along the guide rods, wherein the thread will receive a rapid compensation in length.

If the feeding of the thread is to be stopped, this is made by activation of pneumatic cylinder 20 which then presses the clamp plate 19 against the bar 16. Now the feeding of thread at the end of the robot arm will continue for a short moment while the thread guide 17 moves upwards along the guide rods 11, until the pull in the thread is stopped. When it will be time for restarting the feeding, this will be commenced with a correctly pretensioned thread without the risk of loops or kinks on the thread.

Figure 1:
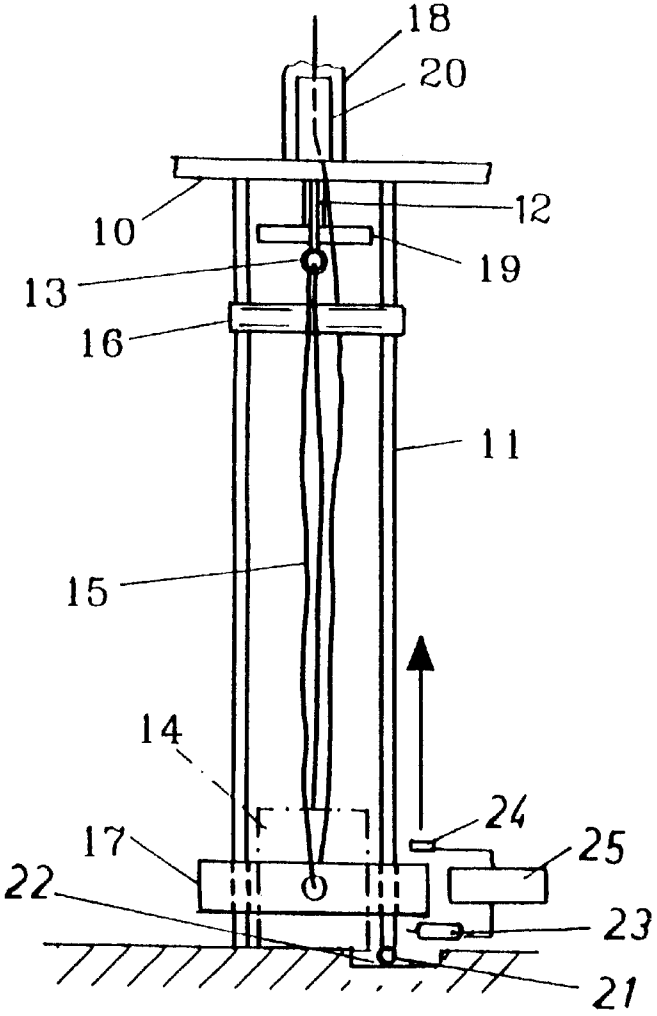
FIG. 1 is a plane view of a thread feeding buffer according to the invention, with the movable thread guide moving upwards, and FIG. 2 a corresponding view showing the movable thread guide according to FIG. 1 moving downwards.

A first one of the vertical guide rods 11 of the stand 10 at its lower end is movable by being supported in a direction to and from the opposite vertical guide rod by means of a ball 31 or the like being movable in a transverse groove 22. In normal operation the lower end of the said first vertical guide rod 11 is in its neutral position, as shown in FIG. 1, where the yoke provided with the movable thread guide 17 is moving upwards.

A means causing motion of the said movably supported lower end of the first guide rod, preferably a force piston 23 is provided for causing such transverse movement at a rapid downward movement of the yoke a force piston 23 in order to cause that the space between the two vertical guide rods is reduced so much that the yoke with the movable thread guide 17 is clamped in wedge-form and thereby will not make any bounce.

The movement of the yoke is preferably monitored by a sensor 24 thus that a rapid downward movement of the yoke makes the sensor emit a signal for activating the force piston 23. This sensor is preferably connected to a central unit 25 receiving a signal from the sensor 24, representing the current speed of the yoke, whereby the signal is compared to a threshold value in said central unit, whereby the central unit is arranged to emit an output activating the force piston 23 when the sensed downward speed of the yoke exceeds said threshold value.

The invention is not limited to the above described embodiment, but several variations are possible within the frame of the accompanying claims. For example, the guide rods can be exchanged for other means for controlling a buffer of fibre thread. Further, a spring means can replace the action of gravity upon the thread guide means 17.

What is claimed is:

1. A thread entanglement protection arrangement for a thread feeding buffer for a fiber thread fed from a supply and along a path comprising:

a first guide for the thread for receiving the thread from the supply, a contactable brake surface over which the thread is fed from the first guide; a brake movable into contact with the brake surface for braking movement of the thread past the brake surface;

a movable thread guide in the path of the thread past the brake surface, a support comprising two generally parallel, substantially vertically arranged guide rods supporting the movable thread guide for substantially vertical movement along the guide rods;

a brake arrangement at the guide rods, the brake arrangement acting on one of the guide rods for moving the one guide rod with reference to the other guide rod changing the distance between the guide rods for selectively braking downward movement of the movable thread guide;

a further guide following the movable thread guide in the path of the thread and past which the thread is drawn;

the support enabling the movable thread guide to be moved by the thread to reduce the length of the thread path between the brake surface and the further thread guide upon the brake element engaging the brake surface and also permitting the movable thread guide to move to lengthen the distance between the brake surface and the further thread guide to absorb slack in the thread on the path between the brake surface and the further thread guide.

2. The arrangement of claim 1 wherein the brake arrangement comprises the one guide rod having a lower end which is movable toward and away from the other of the guide rods for providing a braking effect on the downward motion of the movable thread guide.

3. The arrangement of claim 2, wherein the lower end of the one rod is movable toward the other rod at the lower end thereof for causing a clamping braking effect on the movable thread guide moving downward.

4. The arrangement of claim 3, further comprising a track engaged by the lower end of the one rod for guiding the movement of the lower end of the one rod.

5. The arrangement of claim 4, wherein the track comprises a ball rolling track for the lower end of the one guide rod.

6. The arrangement of claim 3, wherein the brake arrangement comprises a force piston at the one rod for pushing the lower end of the one rod toward the other rod and for causing a clamping braking effect on the downward motion of the movable thread guide.

7. The arrangement of claim 6, further comprising a sensor for sensing rapid downward motion of the movable thread guide, the sensor being connected with the force piston for operating the force piston to move the lower end of the one rod toward the other rod when the sensor senses rapid downward motion of the movable thread guide.

8. The arrangement of claim 7, further comprising a central unit in communication with the sensor for receiving a signal from the sensor representative of the speed of downward motion of the thread guide, the central unit including means for comparing the sensed downward motion speed with a threshold value and for providing an output for activating the force piston when the downward motion speed sensed by the sensor exceeds the threshold value.

9. The arrangement of claim 3, further comprising a sensor for sensing rapid downward motion of the movable thread guide, the sensor being connected with the brake arrangement for operating the brake arrangement to move the lower end of the one rod toward the other rod when the sensor senses rapid downward motion of the movable thread guide.

10. The arrangement of claim 9, further comprising a central unit in communication with the sensor for receiving a signal from the sensor representative of the speed of downward motion of the thread guide, the central unit including means for comparing the sensed downward movement speed to a threshold value and for providing an output for activating the brake arrangement when the downward motion speed sensed by the sensor exceeds the threshold value.

11. The arrangement of claim 1, wherein the support supports the movable thread guide for movement in the vertical direction so that the movable thread guide is normally acted upon by gravity; and the first guide and the further guide are both located vertically above the movable thread guide so that the movable thread guide can move up and down to absorb slack in the thread.

12. The arrangement of claim 1, wherein the brake surface comprises a runner over which the thread runs and the brake element comprises a pneumatic cylinder and a clamp movable with respect to the cylinder for clamping against the brake surface.

13. The arrangement of claim 1, wherein the first guide and the movable thread guide respectively comprise eyelets through which the thread passes.

14. The arrangement of claim 1, wherein the first guide and the further guide are stationary, relative to the movement of the movable thread guide.

* * * * *